US006769563B2

(12) United States Patent
Tumlin et al.

(10) Patent No.: US 6,769,563 B2
(45) Date of Patent: Aug. 3, 2004

(54) MOLDED AEROSOL CAN CAP

(75) Inventors: Ricky W. Tumlin, Acworth, GA (US); L. Cullen Underwood, Woodstock, GA (US)

(73) Assignee: L.L. Culmat, L.P., Woodstock, GA (US)

( * ) Notice: Subject to any disclaimer, the term of this patent is extended or adjusted under 35 U.S.C. 154(b) by 0 days.

(21) Appl. No.: 10/283,607

(22) Filed: Oct. 30, 2002

(65) Prior Publication Data

US 2004/0084454 A1 May 6, 2004

(51) Int. Cl.[7] ..... B65D 43/26
(52) U.S. Cl. ..... 220/284; 215/215
(58) Field of Search ..... 220/284, 285, 220/724, 915, 286; 215/215, 302, 303, 304; 222/153.1

(56) References Cited

U.S. PATENT DOCUMENTS 3,532,249 A 10/1970 Gach
3,633,789 A 1/1972 Markowitz
3,802,607 A 4/1974 Mead
3,804,286 A * 4/1974 Watson et al. ..... 220/284
3,854,622 A 12/1974 McKirnan
3,870,187 A 3/1975 Bennett
3,934,751 A 1/1976 Green et al.
4,165,014 A 8/1979 Ruscitti
4,303,175 A 12/1981 Lux
4,355,729 A * 10/1982 Maguire ..... 215/215
5,040,694 A 8/1991 Gambello
5,788,107 A 8/1998 Meyer et al.
6,112,933 A 9/2000 Meyer et al.

* cited by examiner

*Primary Examiner*—Lien Ngo
(74) *Attorney, Agent, or Firm*—Brinks Hofer Gilson & Lione

(57) ABSTRACT

A one-piece aerosol can cap formed of molded plastic has a top wall with an outside edge. A skirt depends from the outside edge of the top wall to a lower perimeter edge. A plurality of arcuate segments depends from the top wall inside the skirt. Each arcuate segment has an inwardly protruding detent. Each arcuate segment has an inner wall and an outer wall coupled to each other so as to define a space between the walls. An opening is provided in the top wall leading to the space between the walls of an arcuate segment for receiving a tool capable of moving the lower end of the arcuate segment outward sufficiently to release the detent so that the cap can be removed.

15 Claims, 3 Drawing Sheets

MOLDED AEROSOL CAN CAP

BACKGROUND OF THE INVENTION

The present invention relates to tamper-resistant caps for containers and particularly to molded lids and caps for covering the top of aerosol cans that are typically employed to contain paint, lacquer, and other similar materials with a propellant to permit dispensing of the same through a dispensing valve and nozzle after removal of the lid or cap. The present invention is more particularly focused on a cap that is easily attached to a ridge or lip that is present at the top of a necked-in container, but resists removal except with the aid of a simple removal tool such as a screwdriver or other flat bladed instrument.

A typical form of an aerosol can is the so-called "necked-in" can that is usually made of steel and includes a cylindrical body. A dome-shaped shoulder portion is coupled to the top of the cylindrical body to form an annular lip around the top edge of the cylindrical body. The dome-shaped shoulder portion includes a necked-in portion defining a small opening at an upper end that receives a dispensing valve. The dispensing valve is generally coupled to the dome-shaped shoulder portion by a cup shaped metal flange having an outer edge that is secured to the necked-in portion by a rolled over collar that forms a ridge. A spray button is coupled to the dispensing valve to control discharge of pressurized material in the can.

A plastic cap is typically mounted on top of the aerosol can to cover the aerosol spray button of the dispensing valve. To release the pressurized contents of the can in a controlled manner, it is necessary to remove the cap to access the aerosol spray button. Such caps are typically formed in a mold using a plastics material such as polypropylene or high-density polyethylene. The caps are often molded to include a shell conforming generally to the outside diameter of the aerosol can and various internal ribs and flanges adapted to secure the cap to the top of the aerosol can. Molded caps of this general construction can also be used to cover the discharge openings provided in containers other than aerosol cans.

Some plastic caps simply engage an inner or outer edge created around the top edge of the cylindrical body by the annular lip coupling the dome-shaped shoulder portion to the top of the cylindrical body. Such plastic caps are generally easily removed and replaced, even without the use of any tools, thus contributing to possible tampering with, or unauthorized dispensing of, the contents of the aerosol can. Some plastic caps of this type do require a removal tool, such as a screwdriver, be inserted between the lower edge of the cap and the annular lip coupling the dome-shaped shoulder portion to the top of the cylindrical body. Examples of such caps are to be found in U.S. Pat. Nos. 3,334,769 and 3,414,167.

Some other caps include a shell conforming generally to the outside diameter of the aerosol can and an internal structure that engages the ridge presented by the rolled collar junction of the cup shaped metal flange around the dispensing valve and the top of the dome-shaped shoulder portion. Examples of such caps are to be found in U.S. Pat. Nos. 3,633,789; 3,802,607; 3,854,622; 3,807,187; 3,934,751; 4,165,014; 4,303,175; and 5,040,694. While such plastic caps are usually designed to be more difficult for children to remove, the designs do little to deter product tampering and unauthorized dispensing by adults.

Some still more secure plastic caps having the internal structure that engages the ridge presented by the rolled collar junction do require the use of a removal tool, such as a screwdriver, to remove the cap from the aerosol container. Examples of such caps are to be found in U.S. Pat. Nos. 3,532,249; 5,788,107; and 6,112,933. However, a potential hazard is presented by such caps that require use of the removal too in that the act of removal of the cap from the aerosol container can cause damage to, and can even puncture, the dome-shaped shoulder portion of the container.

Despite the enhanced security provided by the caps in the prior art, there is still a need for a one piece cap that requires the use of a removal tool, such as a screwdriver, to disengage the cap from the ridge presented by the rolled collar junction, but requires the removal tool to be inserted and used in a manner that will lessen the likelihood of any damage to the aerosol container.

SUMMARY OF THE INVENTION

An aerosol can cap of the present invention is formed by one piece of molded plastic having a top wall with an outside edge. A skirt depends from the outside edge of the top wall to a lower perimeter edge. A plurality of arcuate segments depends from the top wall inside the skirt. Each arcuate segment has an inwardly protruding detent. Each arcuate segment is formed by an inner wall and an outer wall coupled to each other so as to define a space between the walls. An opening is provided in the top wall leading to the space between the walls of an arcuate segment for receiving a removal tool.

The aerosol can cap of the present invention can have a top wall that is substantially planar, but other configurations for the top are also possible such as upwardly domed and cone shaped. The outside edge of the top wall is typically substantially circular and the skirt is typically cylindrical, although other shapes would be possible when desired to conform to or complement the shape of the container to which the cap is to be applied. The lower perimeter edge of the skirt preferably defines a plane so that one seeking to remove the cap from any aerosol can to which the cap has been applied will be discouraged from attempting to insert a removing tool below the skirt lower perimeter edge.

Each arcuate segment preferably includes a bottom wall joining lower ends of the inner wall and outer wall that is of sufficient strength as to successfully resist attempts at puncturing the lower wall by any cap removing tool. The bottom wall joining the lower ends of the inner and outer walls also acts to transfer to the inner wall any force or torque applied to the outer wall by any cap removing tool, which can be used to disengage the inwardly protruding detent on the arcuate segment from any aerosol can to which the cap has been applied. Preferably, the inwardly protruding detent is positioned at a lower end of each arcuate segment inner wall so that outward displacement of any arcuate segment will be sufficient to release the cap from any aerosol can to which the cap has been applied. Each arcuate segment preferably also includes end walls joining the inner wall to the outer wall to contain any cap removing tool within the opening defined by the arcuate segment and inhibit debris from entering between the cap and the top of the aerosol can to which the cap has been applied.

The cap of the present invention is quickly and easily snapped onto the top of an aerosol container. Once in place, the cap of the present invention resists removal except when a removal tool, such as a screwdriver, is inserted substantially vertically downward through an opening in the top wall into one of the plurality of arcuate segments. The removal tool handle is then displaced toward the axis of the aerosol container and cap, which causes an outward movement of the lower end of the arcuate segment in which the removal tool is engaged, thereby releasing the inwardly protruding detent from below the ridge presented by the rolled collar junction between the dispensing valve flange and the dome-shaped shoulder portion of the container. The displacement of the removal tool handle also causes a torque to be applied to the cap that promotes the separation of the cap from the container.

One feature of the present invention is the generally vertically oriented openings in the top wall leading down into the closed end arcuate segments that are intended to receive a removal tool such as a screwdriver. The closed end arcuate segments advantageously restrict the downward movement of the removal tool so that the puncturing or other damage to the top of the aerosol container is significantly inhibited or prevented.

Another feature of the present invention is the positioning of the openings in the top wall leading down into the closed end arcuate segments outward from the axis of the aerosol container. The positioning of the openings advantageously translates the displacement force exerted by the removal tool that moves the inwardly protruding detent from below the rolled collar junction ridge into a torque lifting one side of the cap, thus quickly releasing the cap from engagement with the top of the aerosol container.

Further features and advantages of the invention will become apparent to those skilled in the art from the following discussion of the preferred embodiments as depicted in the accompanying drawings.

DESCRIPTION OF THE ILLUSTRATED PREFERRED EMBODIMENTS

Figure 1:
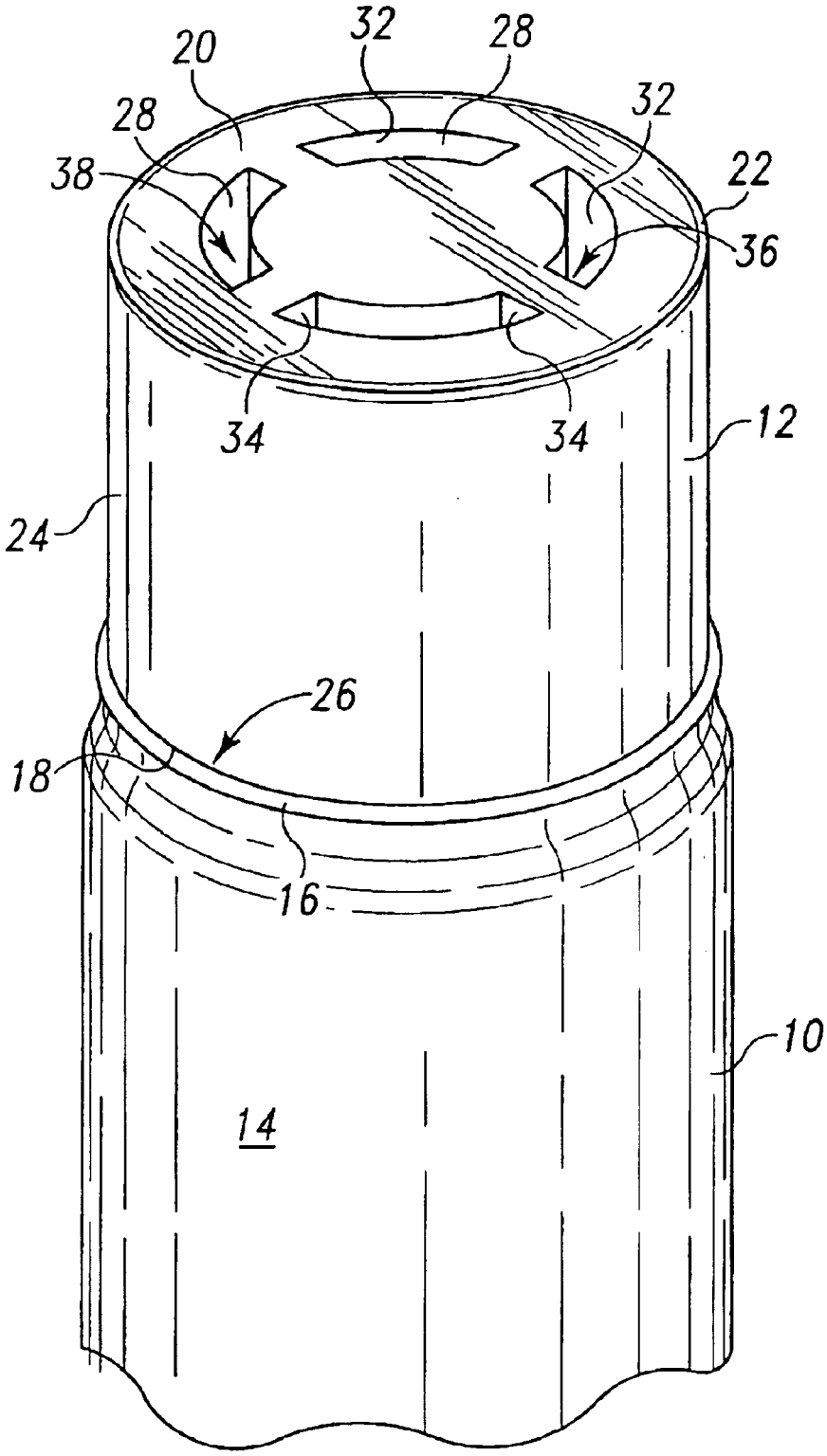
FIG. 1 is a perspective view of an aerosol container and cap of the present invention.

An aerosol can 10 is shown in FIG. 1 with a cap 12 of the present invention. The can 10 has a sidewall 14 having an upper edge 16 that is included in a rolled seam 18. The cap 12 is formed by one piece of molded plastic and has a top wall 20 with an outside edge 22. A skirt 24 depends from the outside edge 22 of the top wall 20 to a lower perimeter edge 26 that is situated just below and inside the rolled seam 18. Four arcuate segments 28 depend from the top wall 20 inside the skirt 24. Each arcuate segment 28 is formed by an inner wall 30 and an outer wall 32. The walls 30 and 32 are coupled to each other by side walls 34 so as to define a space 36 between the walls 30 and 32. Openings 38 are provided in the top wall 20 leading to the space 36 between the walls of the arcuate segments 28 for receiving a removal tool shown in FIG. 4.

Figure 2:
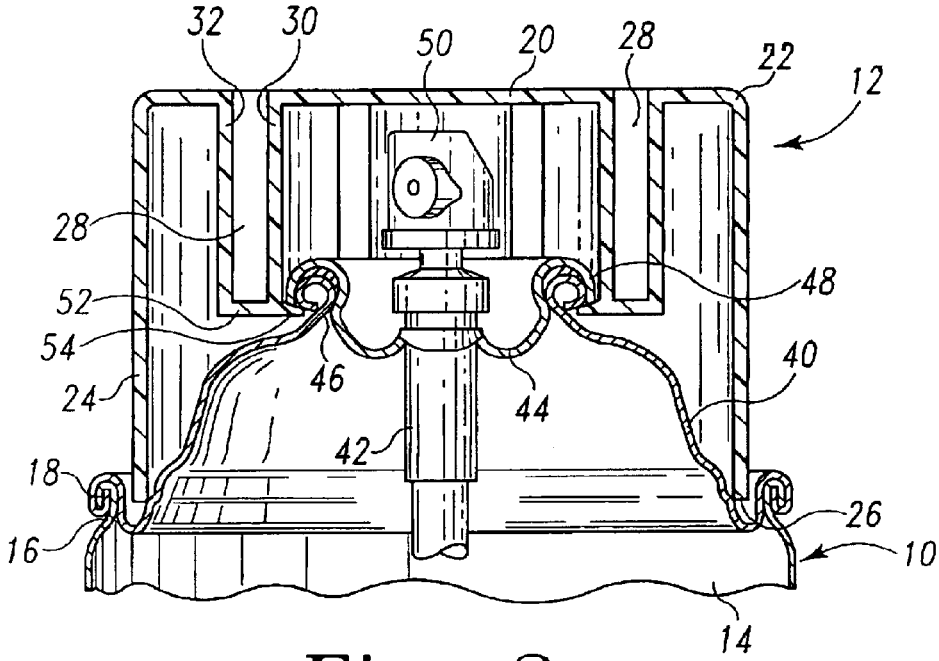
FIG. 2 is a sectional view of an aerosol container and cap of the present invention.

A typical form of an aerosol can 10 is shown in greater detail in FIG. 2. The illustrated can 10 is the so-called "necked-in" can that is usually made of steel and includes a cylindrical sidewall 14 forming a cylindrical body. A dome-shaped shoulder portion 40 is coupled to the top 16 of the cylindrical sidewall 14 by the rolled seam 18 forming an annular lip around the top edge of the cylindrical body. The dome-shaped shoulder portion 40 includes a small opening at an upper end that receives a dispensing valve 42. The dispensing valve 42 is coupled to the dome-shaped shoulder portion 40 by a cup shaped metal flange 44 having an outer edge that is secured in the opening by a rolled over collar 46 that forms an outwardly protruding ridge 48. A spray button 50 is coupled to the dispensing valve 42 to control discharge of pressurized material in the can 10.

A cap 12 of the present invention is shown in FIG. 2 coupled to the aerosol can 10. The cap 12 of FIG. 2, like the cap of FIG. 1, has a top wall 20 with an outside edge 22. The skirt 24 depends from the outside edge 22 of the top wall 20 to the lower perimeter edge 26 that is situated just below and inside the rolled seam 18. The arcuate segments 28 depend from the top wall 20 inside the skirt 24. Each arcuate segment 28 is formed by an inner wall 30 and an outer wall 32. The walls 30 and 32 are coupled to each other by a bottom wall 52. Each arcuate segment 28 has a detent 54 formed on the lower edge of the inner wall 30 that extends under the outwardly protruding ridge 48 of the rolled over collar 46 so as to secure the cap 12 onto the container 10.

Figure 3:
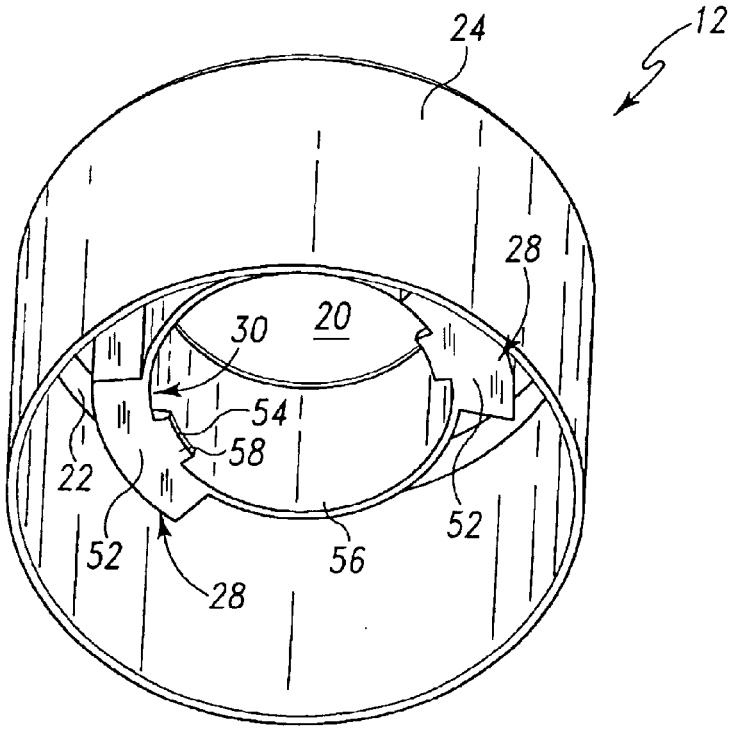
FIG. 3 is a perspective view of a cap of the present invention.
Figure 4:
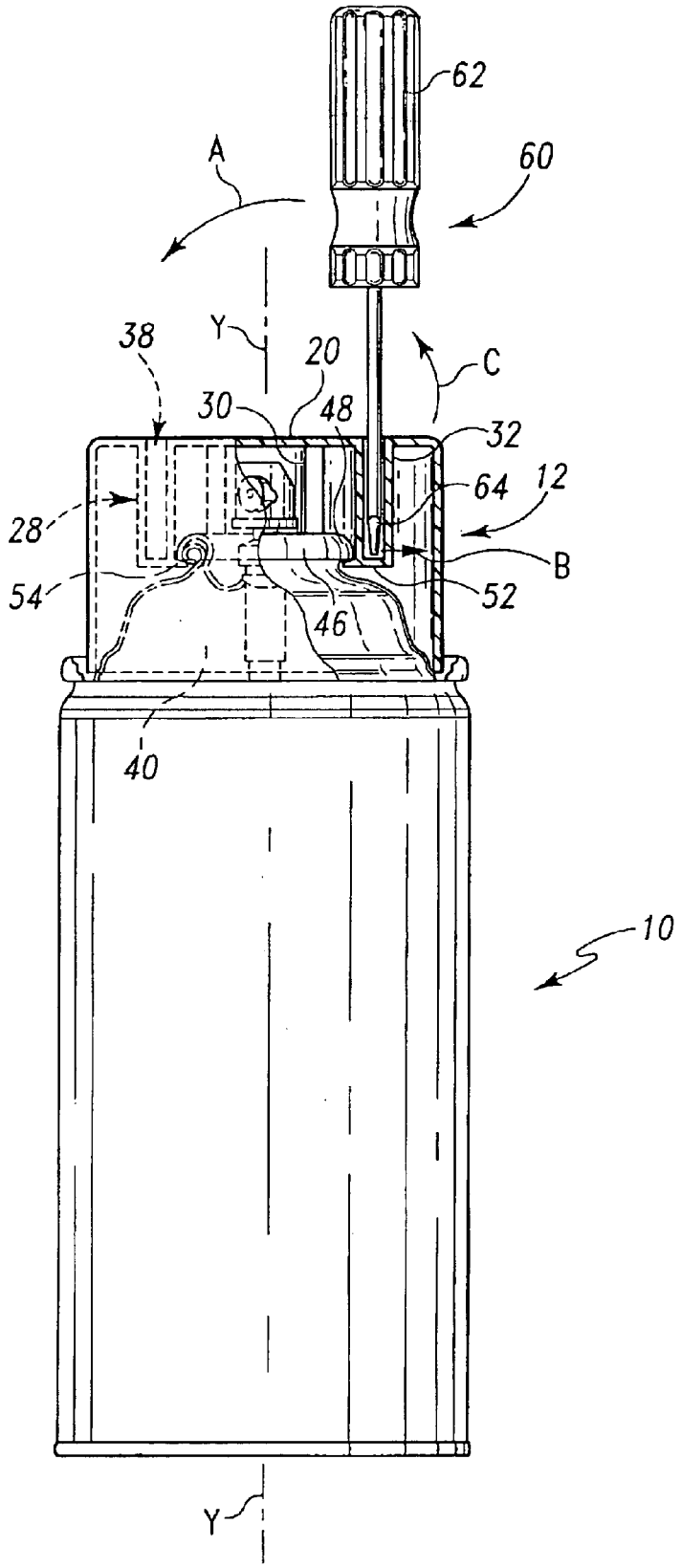
FIG. 4 is a schematic view showing the use of a removal tool to remove a cap of the present invention from an aerosol container.

The inwardly extending detent 54 is more easily seen in FIG. 3, which shows a cap 12 having only two arcuate segments 28. The inwardly extending detent 54 is confined to only a minor lateral portion of the inner wall 30 of each segment 28. A joining portion 56 joins the inner walls 30 of the arcuate segments 28 together to form a continuous band adapted to surround the rolled over collar 46 of the aerosol container to which the cap is attached. The detent 54 is seen to have a tapered lower edge 58 that facilitates the coupling of the cap 12 to a can 10. The cap 10 is quickly and easily snapped onto the top of an aerosol container 10. Once in place, the cap 12 resists removal, except when a removal tool 60, such as a screwdriver, is inserted substantially vertically downward through the opening 38 in the top wall 20 into one of the plurality of arcuate segments 28 as shown in FIG. 4.

When the removal tool 60 is inserted substantially vertically downward through the opening 38 in the top wall 20, the tool handle 62 is positioned above the top wall 20 and the tool blade 64 is positioned between the inner wall 30 and the outer wall 32 of one of the plurality of arcuate segments 28. The removal tool handle 62 can then displaced toward the axis Y of the aerosol container 10 and cap 12, which causes an outward movement of the bottom wall 52 by virtue of the center of the top wall 20 acting as a fulcrum. The movement of the handle 62 in the direction of arrow A causes an outward movement in the direction of arrow B of the inner wall 30 including the detent 54, thereby releasing the inwardly protruding detent 54 from below the ridge 48 presented by the rolled collar 46. The displacement of the removal tool handle 60 also causes a torque to be applied to the cap in the direction of arrow C that promotes the separation of the cap 12 from the container 10. The bottom wall 52 also acts to inhibit the removal tool 60 from contacting dome-shaped shoulder portion 40, thus reducing the likelihood of damage to the container 10 by the removal tool 60.

Of course, numerous modifications can be made to the exemplified embodiments described above without departing from the scope of the invention as defined in the following claims, including all equivalents, which are intended to define the spirit and scope of this invention.

What is claimed is:

1. A one piece molded plastic cap comprising:

a top wall having an outside edge, a skirt depending from the outside edge of the top wall to a lower perimeter edge, and a plurality of arcuate segments depending from the top wall inside the skirt, each arcuate segment having an inwardly protruding detent, each arcuate segment being further defined by an inner wall, an outer wall, and a bottom wall joining lower ends of the inner wall and outer wall so as to define a space between the walls, an opening in the top wall leading to the space between the walls of an arcuate segment for receiving a removal tool.

2. The molded plastic cap of claim 1 wherein the top wall is substantially planar and the outside edge of the top wall is substantially circular.

3. The molded plastic cap of claim 1 wherein the skirt is cylindrical and the lower perimeter edge of the skirt defines a plane.

4. The molded plastic cap of claim 1 wherein the inwardly protruding detent is positioned at a lower end of each arcuate segment inner wall.

5. The molded plastic cap of claim 1 further comprising a joining portion joining the inner walls of all the arcuate segments together.

6. The molded plastic cap of claim 1 wherein the bottom wall of each arcuate segment is parallel to said top wall.

7. A one piece molded plastic cap comprising: a top wall having an outside edge, a skirt depending from the outside edge of the top wall to a lower perimeter edge, and a plurality of arcuate segments defined by an inner wall and an outer wall, the arcuate segment inner and outer walls depending from the top wall inside the skirt, each arcuate segment having an inwardly protruding detent positioned at a lower end of each inner wall, the inner and outer walls of each arcuate segment being coupled to each other so as to define a space between the walls, an opening in the top wall leading to the space between the walls of an arcuate segment for receiving a removal tool.

8. The molded plastic cap of claim 7 wherein the top wall is substantially planar and the outside edge of the top wall is substantially circular.

9. The molded plastic cap of claim 7 wherein the skirt is cylindrical and the lower perimeter edge of the skirt defines a plane.

10. The molded plastic cap of claim 7 wherein each arcuate segment further comprises an end wall joining the inner wall to the outer wall.

11. The molded plastic cap of claim 7 further comprising a joining portion joining the inner walls of all the arcuate segments together.

12. A one piece molded plastic cap comprising: a top wall having an outside edge, a skirt depending from the outside edge of the top wall to a lower perimeter edge, and a plurality of arcuate segments depending from the top wall inside the skirt, each arcuate segment having an inwardly protruding detent, each arcuate segment being further defined by an inner wall and an outer wall coupled to each other so as to define a space between the walls, a joining portion joining the inner walls of all the arcuate segments together, and an opening in the top wall leading to the space between the walls of an arcuate segment for receiving a removal tool.

13. The molded plastic cap of claim 12 wherein the top wall is substantially planar and the outside edge of the top wall is substantially circular.

14. The molded plastic cap of claim 12 wherein the skirt is cylindrical and the lower perimeter edge of the skirt defines a plane.

15. The molded plastic cap of claim 12 wherein each arcuate segment further comprises an end wall joining the inner wall to the outer wall.

* * * * *